United States Patent [19]

Tipton et al.

[11] 3,954,033

[45] May 4, 1976

[54] METHOD AND APPARATUS FOR CUTTING CYLINDERS OF GELATINOUS MATERIALS INTO DISCS OF PRECISE THICKNESS

[75] Inventors: Harold W. Tipton, Woodbridge; John I. Peterson, Falls Church, both of Va.

[73] Assignee: The United States of America as represented by the Secretary of the Department of Health, Education and Welfare, Washington, D.C.

[22] Filed: June 27, 1974

[21] Appl. No.: 483,872

[52] U.S. Cl. ..... 83/51; 83/513; 83/580; 83/646

[51] Int. Cl.[2] ..... B26D 5/10

[58] Field of Search ..... 83/51, 437, 513, 519, 83/523, 580, 598, 618, 646, 701; 82/101

[56] References Cited

UNITED STATES PATENTS

| | | | |
|---|---|---|---|
| 2,106,274 | 1/1938 | Frayer | 83/519 X |
| 2,334,577 | 11/1943 | Postlewaite | 83/598 X |
| 3,449,993 | 6/1969 | Temple et al. | 83/519 X |
| 3,540,333 | 11/1970 | Johnson | 82/101 X |
| 3,759,127 | 9/1973 | Mills | 83/580 X |

*Primary Examiner*—J. M. Meister
*Assistant Examiner*—Fred A. Silverberg
*Attorney, Agent, or Firm*—Browdy and Neimark

[57] ABSTRACT

A method and apparatus for cutting cylinders of gelatinous material such as polyacrylamide gels into discs of precise thickness comprises a cutting surface which is placed in contact with the entire circumference of the cylinder. Cutting force is then applied from all points on the circumference at once, resulting in cutting the gel cylinder towards the center from all points on the circumference. This is accomplished by the use of a multi-bladed diaphragm similar to an iris diaphragm used for camera aperture control. The edges of the blades of the diaphragm form a variable dimension cutting surface.

4 Claims, 5 Drawing Figures

FIG. 1
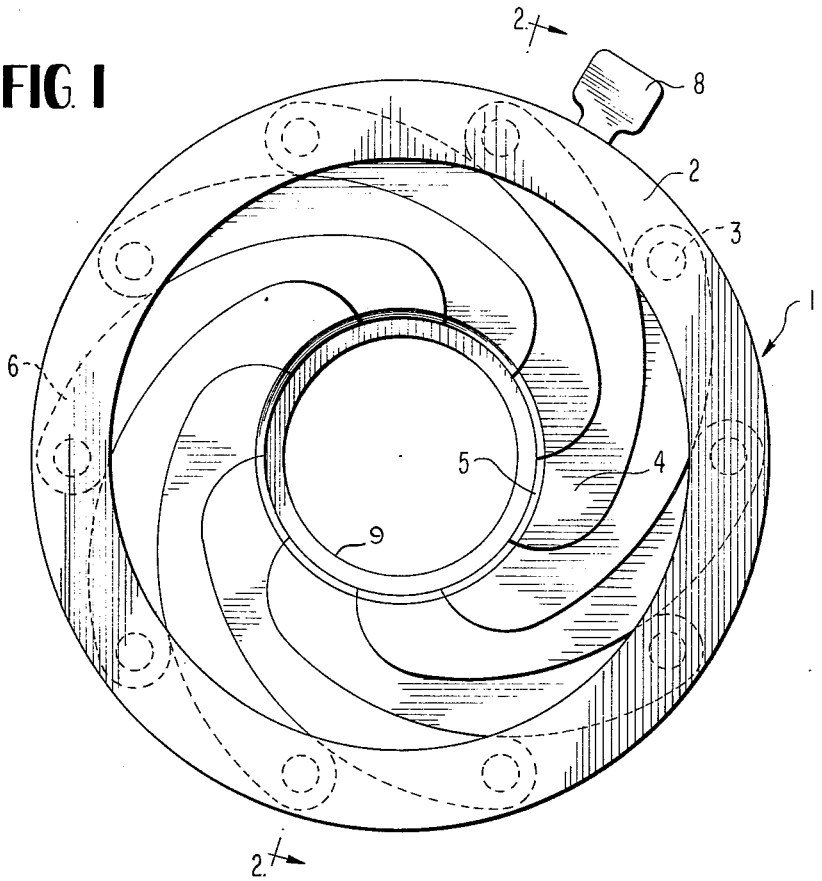
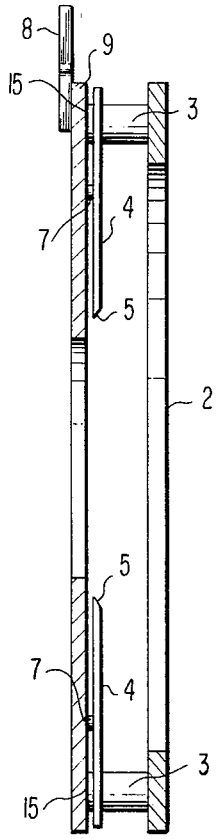
FIG. 2
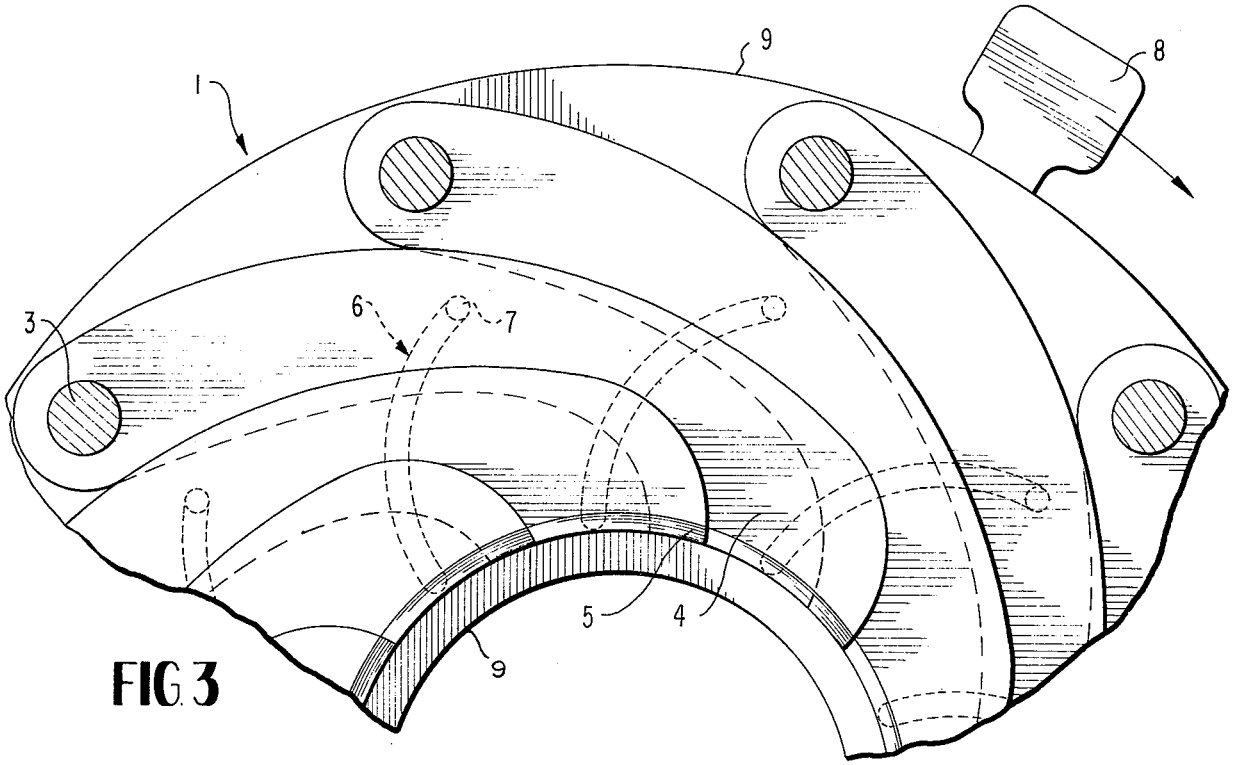
FIG. 3

METHOD AND APPARATUS FOR CUTTING CYLINDERS OF GELATINOUS MATERIALS INTO DISCS OF PRECISE THICKNESS

FIELD OF THE INVENTION

The invention relates to the cutting of gelatinous material into discs of precise thickness and is of particular use in the cutting of gels such as polyacrylamide gels for the purpose of studying the gel structure.

BACKGROUND OF THE INVENTION

Slicing polyacrylamide gel cylinders into discs of precise thickness has been a long-standing problem. Analysis of gel bands is limited by the precision with which the slices can be cut. There is a considerable literature of various devices which have been proposed, but the problem had evaded satisfactory solution. In general, the devices reported in papers or produced commercially fall into two classes: those using the egg slicer approach, in which multiple blades or wires cut across the gel plug simultaneously: or else systems which regularly advance the gel into the path of a very sharp blade moving across the gel.

The patent to Johnson, U.S. Pat. No. 3,450,333 and the patent to Mills, U.S. Pat. No. 3,759,127, both disclose apparatus for the cutting of thin wall cylinders, a non-analogous work product, wherein a plurality of cutting blades are placed to contact with the outer surface of the cylinder and moved radially inwardly during the cutting process. In both of these patents the cutting surface is shown to be a plurality of cutting wheels. In the Johnson patent the tube is rotated as the cutting wheels move inwardly thus applying an approximately equal amount of force around the circumference of the tube and avoiding substantial deformation thereof during the cutting process. In the Mills patent the cutting blades are moved inwardly until their edges touch thereby shearing off the desired length of tube by cutting it all about its circumference.

Neither of these patents, however, discloses the application of the substantially identical cutting force around the entire circumference of the cylinder to be cut. Neither of these two devices disclosed in the patents to Johnson and Mills would be suitable in the environment of the present invention because the use of apparatus similar to those shown in the patents to Mills and Johnson would result in the same deformation problems discussed below with regard to prior art devices which have been used to cut gels into discs.

Other ideas which have been considered for cutting gels are the use of curved blades, rotating blades, moving wires or saw-toothed blades, and the use of freezing to stiffen the gel. Some methods achieve success (defined as a precision of better than 10% relative standard deviation of slice thickness or weight) on some gel formations, but are not universally applicable to any size or consistency of gel.

SUMMARY OF THE INVENTION

The problem of slicing a gel is that the gel is mostly water, given form only by a fibrous network or matrix of an organic polymer throughout its body. Because of the water content, the gel is incompressible; if it is pushed in one place, it squeezes out in another place with equal displacement. The polymer network, although flexible and elastic, has high strength; it is similar to the synthetic fibers commonly used in fabric. A blade, no matter how sharp, cannot cut into the polymer network with a sufficiently small force to avoid distorting and displacing the gel, which is nearly as flexible as a liquid, and it will not cut without tearing.

The solution to the problem is basically a matter of cutting into the gel cylinder all around its circumference at once. The cutting force is directed toward the center from all points. This is accomplished with a multibladed diaphragm of overlapping blades commonly used for optical aperture control. The blades, although thin, do not need to be sharp. This, combined with a simple screw mechanism for advancing the gel, has resulted in a simple apparatus which gives 1 mm thick slices of 6 diameter gel cylinders having a precision of a few percent relative standard deviation, regardless of the gel composition. The precision is better than 2% for standard gels, and better than 4% for stacking gels, which are the most difficult to slice.

It is, accordingly, an object of the present invention to overcome the defects of the prior art, such as indicated above.

It is another object to provide gel slices of uniform size.

It is another object to provide for the improved slicing of gel cylinders.

In accordance with the present invention, cylinders of gelatinous material are cut or sliced into discs of precise thickness by exerting cutting force against the entire circumference of the cylinder at the same time. This is accomplished by the use of a multi-bladed diaphragm similar to an iris diaphragm used for camera aperture control. The edges of the blades of the diaphragm forming the aperture opening form a variable dimension cutting surface.

The above and other objects and the nature and advantages of the instant invention will be more apparent from the following description:

BRIEF DESCRIPTION OF THE DRAWING

This invention can be more readily understood from the description of a possible embodiment with reference to the attached drawing in which the following figures are:

FIG. 1 is a front elevational view of the multi-bladed diaphragm cutting apparatus of the present invention.

FIG. 2 is a partial sectional view taken along lines 2—2 in FIG. 1 but which, for purposes of simplicity of illustration, does not show the overlapping blades.

FIG. 3 is a cut-away view of a portion of the multi-bladed diaphragm cutting apparatus of FIG. 1 showing the overlapping blades, the curved grooves and the driving pins in phantom.

DETAILED DESCRIPTION

Figure 4:
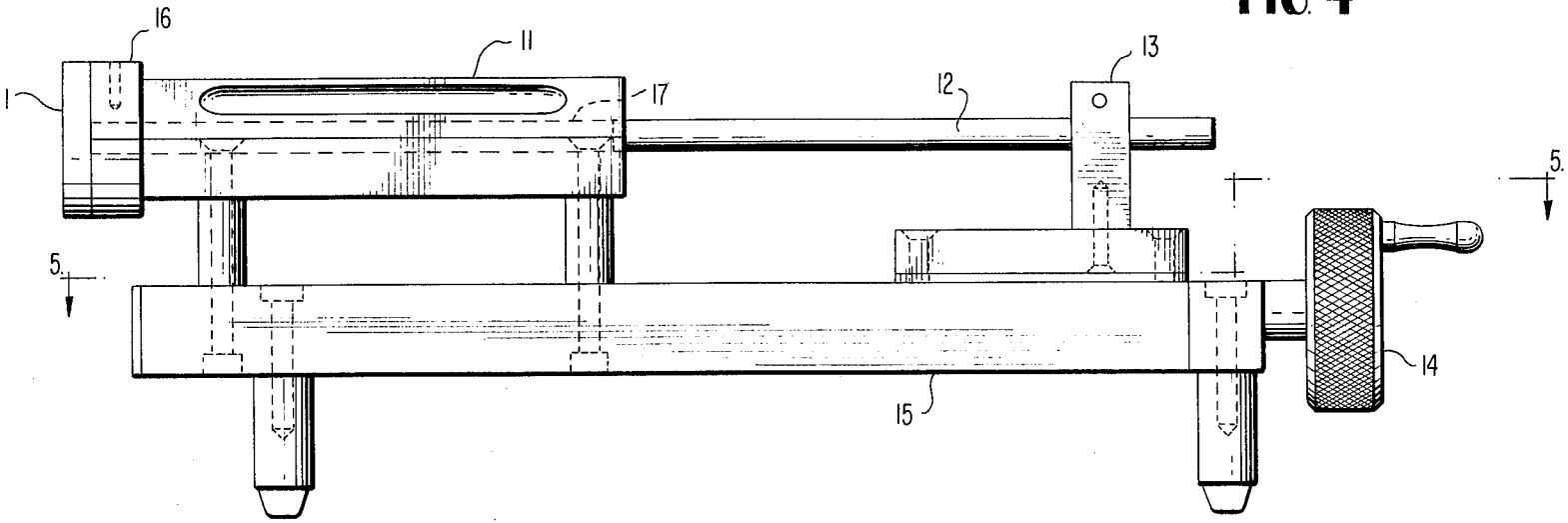
FIG. 4 is a side elevational view of the apparatus of the present invention.

Referring to FIG. 1 there is shown a front elevational view of the multi-bladed diaphragm cutting apparatus of the present invention. A substantially circular mounting plate 2 contains a plurality of blade mounting pivot pins 3 attached thereto. A cutting blade element 4 is rotatably or pivotally mounted upon each of the plurality of blade mounting pivot pins 3. Each of the cutting blade elements comprises a concavely shaped cutting surface 5 as shown in FIG. 1. The combination of all of the cutting surfaces 5 of the cutting blades 4 forms an aperture in the multi-bladed diaphragm which is substantially circular and which encircles the gel cylinder to be cut.

A plurality of drive pins 7, shown in phantom in FIG. 2, are mounted on the cutting blades as illustrated in FIG. 2. A projection 8 extends from a rotating back plate 9 and provides a means for rotating the back plate. Each of the drive pins 7 engages a curved groove 6 of the rotating back plate 9. When the rotating plate 9 is rotated the grooves 6 force each cutting blade 4 inwardly thus causing blades to overlap to a greater degree and the aperture formed by the cutting surfaces 5 to become smaller. As the rotating plate 9 is moved further, the aperture finally approaches closure. When the projection 8 and plate 9 are rotated back in the opposite direction, the grooves 6 engaging the pins 7 on the blades 4 cause the cutting blades 4 to move outwardly and the aperture thereby increases in diameter.

Referring to FIG. 2 the relative position of the mounting plate 2 and the rotating back plate 9 are shown. The blade mounting pivots 3 are connected to the mounting plate 2 and engage but are not connected to the rotating back plate 9. The position of the drive pins 7 is also shown in FIG. 2, located on the cutting blades 4 and extending to engage the grooves on back plate 9.

This feature is further illustrated in FIG. 3 which shows a partial cut-away view of the multi-bladed diaphragm of FIG. 1. A plurality of blade mounting pivot pins 3 extend from the mounting plate 2. Mounted on such pivot pins 3 are the plurality of partially overlapping cutting blades 4 with their inner cutting surfaces 5 combining to form the aperture of the diaphragm. Rotating plate 9 is rotated by movement of projection 8. As can be seen from FIG. 3, the rotation of the rotating plate in the direction shown by the arrow causes the pins 7 which are in contact with the grooves 6 in the rotating plate 9 to force the blades in the direction which causes the aperture made up of the cutting surfaces 5 to decrease in diameter. As the rotating means is moved in the direction opposite to that shown in the arrow, the aperture increases in diameter.

In operation the gel cylinder is placed within the aperture of the multi-bladed diaphragm cutting apparatus. The rotation of back plate 9 causes the aperture of the diaphragm to decrease in diameter in a substantially uniform manner thereby applying cutting pressure to the entire circumference of the gel cylinder simultaneously. This cutting pressure is continually applied until the aperture closes or nearly closes, thereby severing a disc from the gel cylinder.

Figure 5:
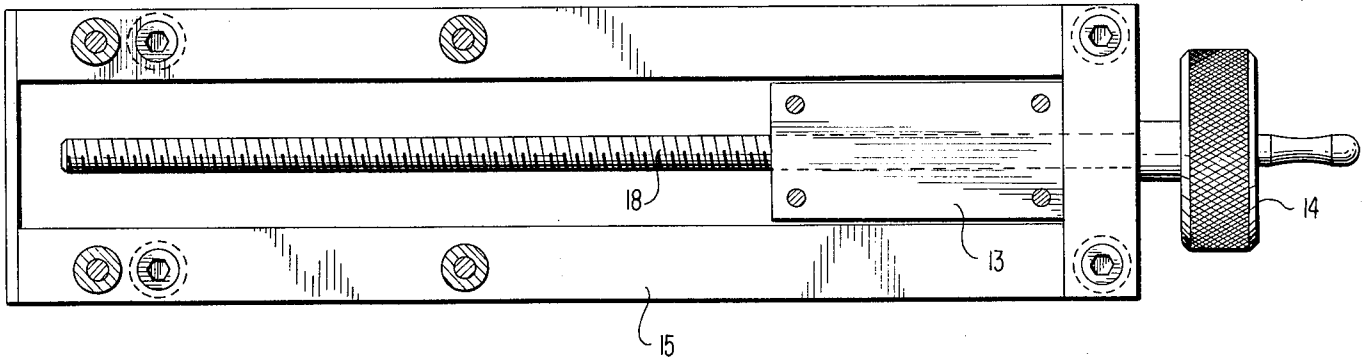
FIG. 5 is a cut-away view of the apparatus of the present invention taken along lines 5—5 of FIG. 4.

FIG. 4 shows a side view of the entire apparatus of the present invention. Multi-bladed diaphragm cutting apparatus 1 is mounted as shown in FIG. 4 on the cutting apparatus mount 16. Gel holder 11 containing a cylindrical opening shown in phantom at 17 feeds the gel to the multi-bladed diaphragm cutting apparatus in response to the movement of gel ram 12 into the cylindrical opening 17. The gel ram 12 is mounted on gel ram mount 13 which is driven by the rotation of handle 14 as shown in greater detail in FIG. 5. FIG. 5 shows the rotating screw gel ram mount drive means 18 which, when rotated by handle 14 causes the gel ram mount 13 to move thereby forcing the gel ram 12 into the cylindrical opening 17 of the gel holder. The entire assembly is supported on a base 15.

In operation, the handle 14, which may be calibrated is rotated the desired amount in order to move the gel cylinder forward through the cylindrical opening a desired amount such that the aperture of the multi-bladed diaphragm cutting apparatus when closed or nearly closed will sever a disc of the desired thickness from the gel cylinder. The device may act on gel cylinder or rods of various sizes made of different gel materials, including acrylamide gel, gelatine, etc.

It will be understood that the basic teaching of the present invention is shown here only in one embodiment thereof and is not intended to limit the invention to the specific apparatus illustrated and described. Rather, it is intended to cover all alternative and equivalent embodiments as would fall within the sphere and scope of the appended claims and their equivalents. Examples of extensions of the present invention are the inclusion of mechanisms for automatic operation of the cutting device in conjunction with advancing the gel into it, and alternate devices or mechanical means of providing blades, wires, etc., which cut the gel by advancing into the gel simultaneously around its circumference.

We claim:

1. A method of slicing cylinders of unfrozen gelatinous material into discs of relatively precise thickness, consisting of the steps of:

placing an aperture-shaped slicer in contact with the unfrozen gel cylinder around the entire circumference of the cylinder at a desired axial position determined by the desired thickness of the disc; and moving the slicer inward radially from all points about the circumference substantially simultaneously at a uniform rate until the aperture of the slicer is substantially closed.

2. Apparatus for slicing cylinders of unfrozen gelatinous material into discs of precise thickness comprising:

slicing means to slice into a gel cylinder all around its circumference at once, including a plurality of slicing surfaces which together form a substantially circular aperture shape for encircling and contacting the unfrozen gel cylinder simultaneously about its entire circumference, said slicing surfaces being simultaneously radially inwardly contractible at a uniform rate, means for axially positioning the gel cylinder with respect to said slicing surfaces, and means to drive said slicing surfaces into said unfrozen gel simultaneously at a uniform rate from the entire circumference of said cylinder to the position where said aperture is substantially closed.

3. Apparatus of claim 2, wherein said slicing means comprises:

a substantially circular mounting plate;

a plurality of slicing blades pivotally mounted on said plate;

a concave slicing surface on each of said blades, said concave slicing surfaces forming said substantially circular slicing surfaces;

said blades and concave slicing surfaces being shaped such that when said blades are uniformly and simultaneously pivoted towards the center of said mounting plate, the circle subscribed by said concave slicing surfaces substantially uniformly decreases in radius.

4. Apparatus of claim 2, wherein said cutting means comprises:

a multi-bladed iris diaphragm.

* * * * *